US007550239B2

(12) United States Patent
Vong et al.

(10) Patent No.: US 7,550,239 B2
(45) Date of Patent: Jun. 23, 2009

(54) ALKYLTRIOL TITANYL PHTHALOCYANINE PHOTOCONDUCTORS

(75) Inventors: Cuong Vong, Hamilton (CA); Ah-Mee Hor, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 275 days.

(21) Appl. No.: 11/656,926

(22) Filed: Jan. 23, 2007

(65) Prior Publication Data

US 2008/0176155 A1 Jul. 24, 2008

(51) Int. Cl.
*G03G 5/06* (2006.01)

(52) U.S. Cl. ..... 430/59.5; 430/58.8

(58) Field of Classification Search ..... 430/58.8, 430/59.5

See application file for complete search history.

(56) References Cited

U.S. PATENT DOCUMENTS

| | | | | |
|---|---|---|---|---|
| 3,121,006 | A | 2/1964 | Middleton et al. | |
| 4,265,990 | A | 5/1981 | Stolka et al. | |
| 4,599,286 | A | 7/1986 | Limburg et al. | |
| 5,153,094 | A | 10/1992 | Kazmaier et al. | |
| 5,166,339 | A | 11/1992 | Duff et al. | |
| 5,189,155 | A | 2/1993 | Mayo et al. | |
| 5,189,156 | A | 2/1993 | Mayo et al. | |
| 5,350,655 | A | 9/1994 | Oshiba et al. | |
| 5,482,811 | A | 1/1996 | Keoshkerian et al. | |
| 5,521,306 | A | 5/1996 | Burt et al. | |
| 6,376,141 | B1 | 4/2002 | Mishra et al. | |
| 6,645,687 | B1 * | 11/2003 | Vong et al. | 430/59.4 |
| 6,713,220 | B2 | 3/2004 | Graham et al. | |
| 6,913,863 | B2 | 7/2005 | Wu et al. | |
| 7,037,631 | B2 | 5/2006 | Wu et al. | |
| 2006/0105254 | A1 | 5/2006 | Wu et al. | |
| 2008/0032219 | A1 * | 2/2008 | Lin et al. | 430/58.65 |
| 2008/0138726 | A1 * | 6/2008 | Vong et al. | 430/58.8 |

OTHER PUBLICATIONS

Jin Wu et al., U.S. Appl. No. 11/472,765 on Titanyl Phthalocyanine Photoconductors, filed Jun. 22, 2006.
Jin Wu et al., U.S. Appl. No. 11/472,766 on Titanyl Phthalocyanine Photoconductors, filed Jun. 22, 2006.
Jin Wu et al., U.S. Appl. No. 11/458,467 on Electrophotographic Photoreceptor, filed Jul. 19, 2006.
Cuong Vong et al., U.S. Appl. No. 11/458,519 on Electrophotographic Photoreceptor, filed Jul. 19, 2006.

* cited by examiner

*Primary Examiner*—John L Goodrow
(74) *Attorney, Agent, or Firm*—E. O. Palazzo

(57) ABSTRACT

A photoconductor containing an optional supporting substrate, a photogenerating layer, and at least one charge transport layer, and wherein the photogenerating layer contains an alkyltriol, such as glycerol, and a photogenerating pigment, such as a Type V titanyl phthalocyanine prepared, for example, by dissolving a Type I titanyl phthalocyanine in a solution of a trihaloacetic acid and an alkylene halide; adding the mixture comprising the dissolved Type I titanyl phthalocyanine to a solution of an alcohol and an alkylene halide thereby precipitating a Type Y titanyl phthalocyanine; and treating the Type Y titanyl phthalocyanine with a monohalobenzene.

29 Claims, 2 Drawing Sheets

ALKYLTRIOL TITANYL PHTHALOCYANINE PHOTOCONDUCTORS

CROSS REFERENCES

In U.S. application Ser. No. 11/458,467, U.S. Publication No. 20080020306, filed Jul. 19, 2006, the disclosure of which is totally incorporated herein by reference, there is illustrated a photoconductor with a photogenerating layer containing a compound having two hydroxyl groups bonded to adjoining carbon atoms in the carbon chain.

Commonly assigned U.S. application Ser. No. 11/458,519, U.S. Publication No. 20080020307, filed Jul. 19, 2006, the disclosure of which is totally incorporated herein by reference, discloses an electrophotographic imaging member comprising a substrate, a charge generating layer, and a charge transport layer, wherein the charge generating layer comprises a photogenerating material and a hydroxyl group-containing polymeric compound. The hydroxyl group-containing polymeric compound can be, for example, a hydroxyl group-containing polyvinyl butyral resin, a polyol resin, a polyvinyl alcohol, or a polycarbonate resin.

In U.S. application Ser. No. 11/472,765, U.S. Publication No. 20070298341, filed Jun. 22, 2006, and U.S. application Ser. No. 11/472,766, filed Jun. 22, 2006, the disclosures of which are totally incorporated herein by reference, there are disclosed, for example, photoconductors comprising a photogenerating layer and a charge transport layer, and wherein the photogenerating layer contains a titanyl phthalocyanine prepared by dissolving a Type I titanyl phthalocyanine in a solution comprising a trihaloacetic acid and an alkylene halide; adding said mixture comprising the dissolved Type I titanyl phthalocyanine to a solution comprising an alcohol and an alkylene halide thereby precipitating a Type Y titanyl phthalocyanine; and treating the Type Y titanyl phthalocyanine with a monohalobenzene.

High photosensitivity titanyl phthalocyanines are illustrated in copending U.S. application Ser. No. 10/992,500, U.S. Publication No. 20060105254, the disclosure of which is totally incorporated herein by reference, which, for example, discloses a process for the preparation of a Type V titanyl phthalocyanine, comprising providing a Type I titanyl phthalocyanine; dissolving the Type I titanyl phthalocyanine in a solution comprising a trihaloacetic acid and an alkylene halide; adding the resulting mixture comprising the dissolved Type I titanyl phthalocyanine to a solution comprising an alcohol and an alkylene halide thereby precipitating a Type Y titanyl phthalocyanine; and treating the Type Y titanyl phthalocyanine with monochlorobenzene to yield a Type V titanyl phthalocyanine.

A number of the components of the above cross-referenced applications, such as the supporting substrates, resin binders, antioxidants, charge transport components, titanyl phthalocyanines, such as Type V, hole blocking layer components, adhesive layers, and the like, may be selected for the photoconductor and imaging members or photoconductors of the present disclosure in embodiments thereof.

BACKGROUND

This disclosure is generally directed to drum and layered imaging members, photoreceptors, photoconductors, and the like. More specifically, the present disclosure is directed to drum and multilayered flexible or belt imaging members or devices comprised of an optional supporting medium like a substrate, a photogenerating layer, and a charge transport layer, including a plurality of charge transports layers, such as a first charge transport layer and a second charge transport layer, an optional adhesive layer, an optional hole blocking, or undercoat layer, an optional overcoating layer, and wherein at least one, such as for example from 1 to about 7, from 1 to about 3, and one, of the charge transport layers contains at least one charge transport component, a polymer or resin binder, and an optional antioxidant, and wherein the photogenerating layer contains an alkyltriol, wherein alkyl contains, for example, from 1 to about 20 carbon atoms, from 1 to about 12 carbon atoms, from 1 to about 6 carbon atoms, such as glycerol (1,2,3-propanetriol) and a photogenerating pigment, such as a titanyl phthalocyanine. Moreover, the photogenerating layer dispersion and the photogenerating layer is comprised of a resin binder, an alkyltriol and a high sensitivity titanyl phthalocyanine generated by the processes as illustrated in copending application U.S. application Ser. No. 10/992,500, U.S. Publication No. 20060105254, the disclosure of which is totally incorporated herein by reference. The photoreceptors or photoconductors illustrated herein in embodiments have high photosensitivities, such as greater than a 10 percent higher sensitivity than a photoconductor that is free of an alkyltriol; resistance to and minimal effects to the photogenerating layer dispersion to solvents; excellent wear resistance, and extended lifetimes, and wherein the photogenerating dispersion selected for the preparation of the photogenerating layer is stabilized by an alkyltriol like glycerol, that is for example, minimizing or avoiding a polymorphic crystal structure change in the photogenerating pigment, such as TiOPc, which can result in a loss, such as about 50 percent in photosensitivity. Additionally, in embodiments the imaging members disclosed herein possess excellent, and in a number of instances low $V_r$ (residual potential), and allow the substantial prevention of $V_r$ cycle up when appropriate; high stable sensitivity; low acceptable image ghosting characteristics; and desirable toner cleanability; more rapid transport of holes while maintaining print quality, especially in the presence of the temperature variability in close proximity to the photoconductor; substantially maintaining development voltage stability; and where the print density is excellent for a number of imaging cycles in a xerographic system.

More specifically, there is illustrated herein in embodiments the incorporation into the photogenerating layer imaging members of suitable high sensitivity photogenerating pigments, such as certain titanyl phthalocyanines stabilized with an alkyltriol, which sensitivity is from about 10 to about 50 percent higher than that of similar photoconductors containing as a photogenerating pigment hydroxygallium phthalocyanine Type V, and which layer is formed from a dispersion containing the photogenerating pigment and the alkyltriol; and a number, such as one, of hole transport component layers thereover, and which layers permit the rapid transport of holes.

Also included within the scope of the present disclosure are methods of imaging and printing with the photoresponsive or photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, the imaging members and flexible belts disclosed herein can be selected for the Xerox Corporation iGEN3® machines that generate with some versions over 100 copies per minute. Processes of imaging, especially xerographic imaging and printing, including digital, and/or color printing are thus encompassed by the present disclosure. The imaging members disclosed herein are in embodiments sensitive in the wavelength region of, for example, from about 400 to about 900 nanometers, and in particular from about 650 to about 850 nanometers, thus diode lasers can be selected as the light source. Moreover, the imaging members disclosed herein are in embodiments useful in high resolution color xerographic applications, particularly high-speed color copying and printing processes.

REFERENCES

There is illustrated in U.S. Pat. No. 7,037,631, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

U.S. Pat. No. 4,599,286, the disclosure of which is totally incorporated herein by reference, discloses an electrophotographic imaging member comprising a charge generation layer and a charge transport layer, the transport layer comprising an aromatic amine charge transport molecule in a continuous polymeric binder phase and a chemical stabilizer selected from the group consisting of certain nitrone, isobenzofuran, hydroxyaromatic compounds and mixtures thereof.

U.S. Pat. No. 6,376,141, the disclosure of which is totally incorporated herein by reference, discloses, for example, various references directed to compositions comprising combinations of phthalocyanine pigments to hydroxygallium phthalocyanine pigments. Additionally, for example, U.S. Pat. No. 6,713,220 describes a method of preparing a Type V hydroxygallium phthalocyanine.

U.S. Pat. No. 5,350,655, the disclosure of which is totally incorporated herein by reference, illustrates an electrophotographic photoreceptor comprising a conductive substrate having provided thereon a photosensitive layer, the photosensitive layer comprising a titanylphthalocyanine having a maximum peak, in the Cu—K alpha X-ray diffraction spectrum thereof, at a Bragg angle of 27.2°±0.2°, an alkyldiol compound having 3 to 12 carbon atoms and 2 hydroxyl groups, each hydroxyl group being bonded to a different, non-adjacent carbon atom, the alkyldiol compound being present in an amount of 0.1 to 1,000 parts per 100 parts by weight of the titanylphthalocyanine, and a binder resin selected from the group consisting of polycarbonate, polycarbonate Z, acrylic resin, methacrylic resin, polyvinyl chloride, polyvinylidene chloride, polystyrene, styrene-butadiene copolymer, polyvinyl acetate, polyvinylformal, polyvinylbutyral, polyvinylacetal, polyvinylcarbazole, styrene-alkyd resin, silicone resin, silicone-alkyd resin, silicone-butyral resin, polyester, polyurethane, polyamide, epoxy resin, phenolic resin, vinylidene chloride-acrylonitrile copolymer, vinyl chloride-vinyl acetate copolymer and vinyl chloride-vinyl acetate-maleic anhydride copolymer.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water, concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Some processes for the preparation of photoreceptors from dispersions may be susceptible to many variables, such as, for example, material variables, including contents and purity of the material; process variables, including milling time and milling procedure; and coating process variables, including web coating, dip coating, the drying process of several layers, and the time interval between the coatings of successive layers which, for example, can cause the electrical characteristics of the resulting photoreceptors to be inconsistent during the manufacturing process.

Also, photosensitivity is a valuable electrical characteristic of electrophotographic imaging members or photoreceptors. Sensitivity may be described in two aspects. The first aspect of sensitivity is spectral sensitivity, which refers to sensitivity as a function of wavelength. An increase in spectral sensitivity implies an appearance of sensitivity at a wavelength in which previously no sensitivity was detected. The second aspect of sensitivity, broadband sensitivity, is a change of sensitivity, for example an increase at a particular wavelength previously exhibiting sensitivity, or a general increase of sensitivity encompassing all wavelengths previously exhibiting sensitivity. This second aspect of sensitivity may also be considered as change of sensitivity, encompassing all wavelengths, with a broadband (white) light exposure. A problem encountered in the manufacturing of photoreceptors is maintaining consistent spectral and broadband sensitivity from batch to batch.

Typically, flexible photoreceptor belts are fabricated by depositing the various layers of photoactive coatings onto long webs that are thereafter cut into sheets. The opposite ends of each photoreceptor sheet are overlapped and ultrasonically welded together to form an imaging belt. In order to increase throughput during the web coating operation, the webs to be coated have a width of twice the width of a final belt. After coating, the web is slit lengthwise, and thereafter, transversely cut into predetermined lengths to form photoreceptor sheets of precise dimensions that are eventually welded into belts. The web length in a coating run may be many thousands of feet long, and the coating run may take more than an hour for each layer.

Various types of inorganic photoconductive pigments are known, including pigments based on phthalocyanines. A variety of phthalocyanine-based pigments are suitable for use in photoimaging members, including metal-free phthalocyanines, copper, iron, and zinc phthalocyanines, chloroindium phthalocyanines, hydroxygallium phthalocyanines, chlorogallium phthalocyanines, certain titanium-based phthalocyanines, such as, for example, titanyl phthalocyanine Type IV, and compositions comprising combinations of the above pigments. U.S. Pat. No. 6,376,141, the disclosure of which is totally incorporated herein by reference, illustrates various compositions comprising combinations of phthalocyanine pigments including hydroxygallium phthalocyanine pigments. Additionally, for example, U.S. Pat. No. 6,713,220, the disclosure of which is totally incorporated herein by reference, discloses a method of preparing a Type V hydroxygallium phthalocyanine.

A number of titanyl phthalocyanines, or oxytitanium phthalocyanines, may be considered suitable photogenerating pigments known to absorb near infrared light around 800 nanometers. Generally, titanyl phthalocyanine possesses five main crystal forms known as Types I, II, III, X, and IV, reference U.S. Pat. Nos. 5,189,155 and 5,189,156, the entire disclosures of which are incorporated herein by reference. Additionally, U.S. Pat. Nos. 5,189,155 and 5,189,156 are directed to processes for obtaining Types I, X, and IV phthalocyanines. U.S. Pat. No. 5,153,094, the entire disclosure of which is incorporated herein by reference, relates to the preparation of titanyl phthalocyanine polymorphs including Types I, II, III, and IV polymorphs. U.S. Pat. No. 5,166,339, the disclosure of which is totally incorporated herein by reference, discloses processes for preparing Types I, IV, and X titanyl phthalocyanine polymorphs, as well as the preparation of two polymorphs designated as Type Z-1 and Type Z-2.

To obtain a titanyl phthalocyanine-based photoreceptor having high sensitivity to near infrared light, it is believed of value to control not only the purity and chemical structure of the pigment, as is generally the situation with organic photoconductors, but also to prepare the pigment in a certain and stable crystal modification. Consequently, it is still desirable to provide a photoconductor where the titanyl phthalocyanine is generated by a process that will provide high sensitivity titanyl phthalocyanines.

SUMMARY

Figure 1:
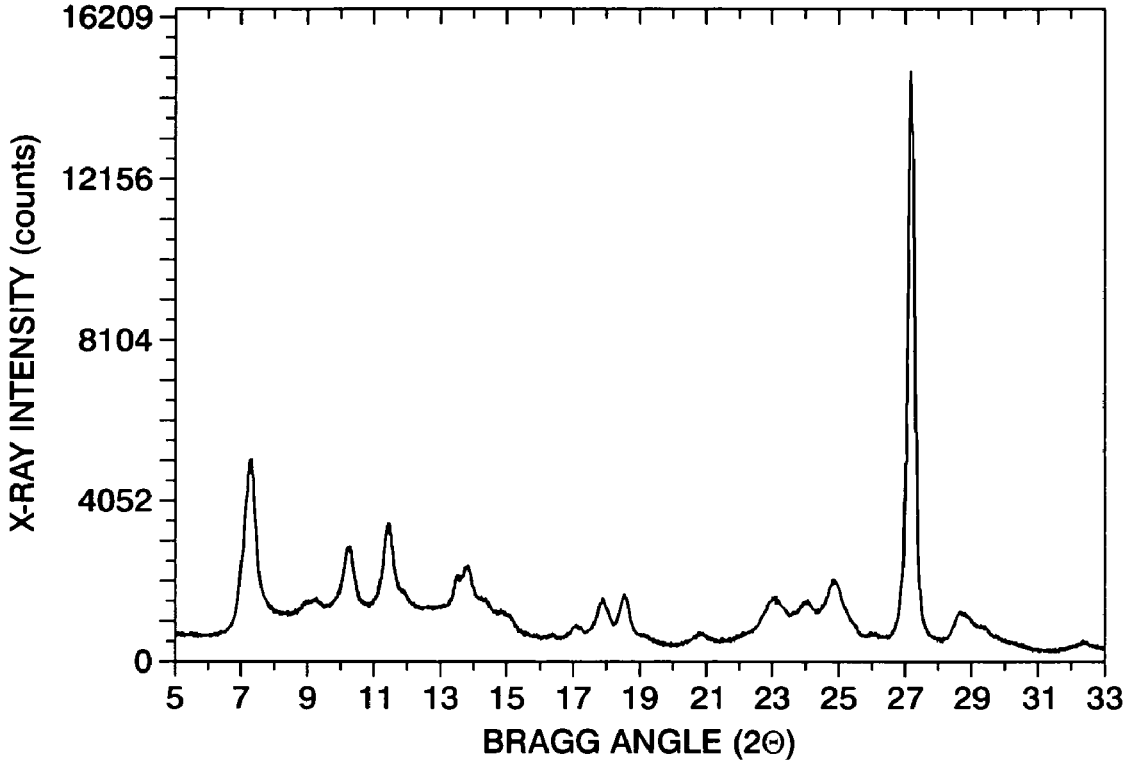
FIG. 1 represents a diffractograph summary of an XRPD of a Type Y titanyl phthalocyanine (TiOPc) with no monochlorobenzene (MCB) conversion.
Figure 2:
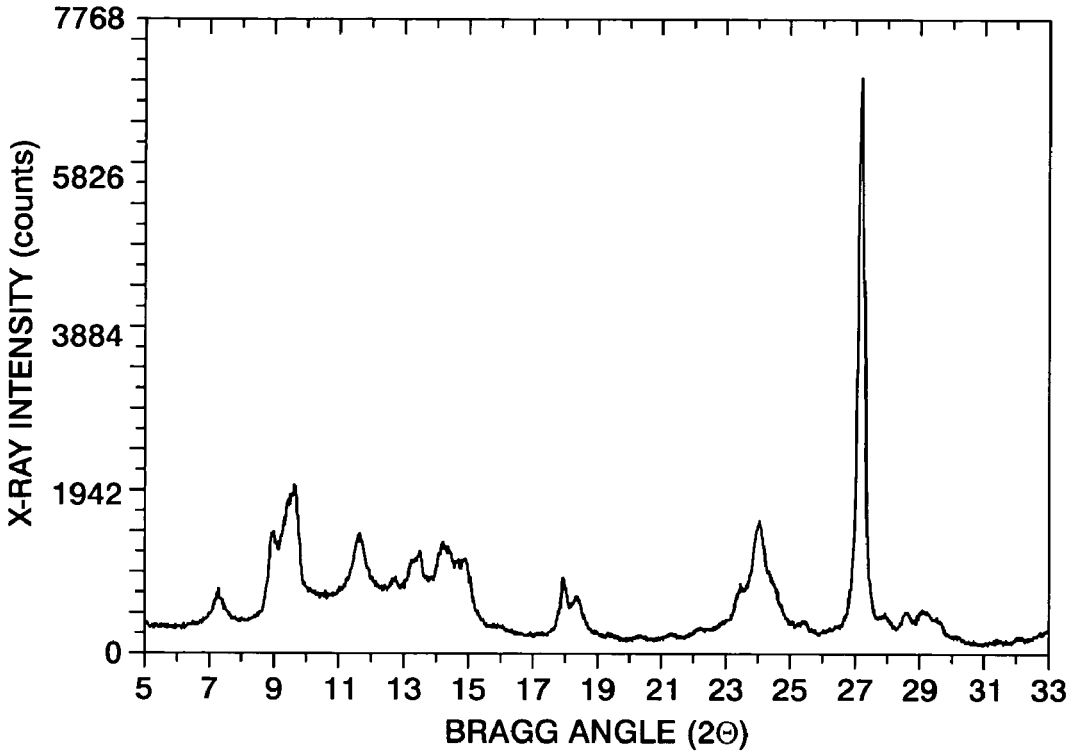
FIG. 2 represents a diffractograph summary of an XRPD of a Type V titanyl phthalocyanine (TiOPc) with a monochlorobenzene (MCB) conversion of about 3 hours.

Disclosed are imaging members with many of the advantages illustrated herein, such as extended lifetimes of service of, for example, in excess of about 3,000,000 imaging cycles; stabilized photogenerating layer pigments, for example, with a photogenerating photoconductor containing a known polyester binder, such as PC(Z), a TiOPc pigment, tetrahydrofuran (THF) and an alkyltriol, like glycerol enabling high stable photoconductor photosensitivity as compared to a similar photoconductor with no alkyltriol which resulted in a substantial loss of photosensitivity caused, it is believed, by the crystal structure change in the TiOPC; rapid charge transfer to thereby improve print quality caused by temperature variation in proximity to the photoconductor; excellent electrical characteristics, for example high sensitivity; stable electrical properties; low image ghosting; resistance to charge transport layer cracking upon exposure to the vapor of certain solvents; excellent surface characteristics; improved wear resistance; compatibility with a number of toner compositions; the avoidance of or minimal imaging member scratching characteristics; consistent $V_r$ (residual potential) that is substantially flat or no change over a number of imaging cycles as illustrated by the generation of known PIDC (Photoinduced Discharge Curve), and the like.

Also disclosed are layered flexible and drum photoresponsive imaging members, and photoconductors which are responsive to near infrared radiation of from about 700 to about 900 nanometers, and where the layered belt and drum photoresponsive or photoconductive imaging members are mechanically robust and solvent resistant with rapid transport of charge, especially holes.

Additionally disclosed are flexible imaging members with optional hole blocking layers comprised of metal oxides, phenolic resins, and optional phenolic compounds, and which phenolic compounds contain at least two, and more specifically, two to ten phenol groups or phenolic resins with, for example, a weight average molecular weight ranging from about 500 to about 3,000, permitting, for example, a hole blocking layer with excellent efficient electron transport which usually results in a desirable photoconductor low residual potential $V_{low}$.

EMBODIMENTS

In an electrostatographic reproducing apparatus for which the photoconductors disclosed herein may be selected, a light image of an original to be copied is recorded in the form of an electrostatic latent image upon a photosensitive member, and the latent image is subsequently rendered visible by the application of electroscopic thermoplastic resin particles, which are commonly referred to as toner. Specifically, the photoreceptor is charged on its surface by means of an electrical charger to which a voltage has been supplied from a power supply. The photoreceptor is then imagewise exposed to light from an optical system or an image input apparatus, such as a laser and light emitting diode, to form an electrostatic latent image thereon. Generally, the electrostatic latent image is developed by a developer mixture of toner and carrier particles. Development can be accomplished by known processes, such as a magnetic brush, powder cloud, highly agitated zone development, or other known development process.

After the toner particles have been deposited on the photoconductive surface in image configuration, they are transferred to a copy sheet by a transfer means, which can be pressure transfer or electrostatic transfer. In embodiments, the developed image can be transferred to an intermediate transfer member, and subsequently transferred to a copy sheet.

When the transfer of the developed image is completed, a copy sheet advances to a fusing station with fusing and pressure rolls wherein the developed image is fused to the copy sheet by passing the copy sheet between the fusing member and the pressure member, thereby forming a permanent image. Fusing may be accomplished by other fusing members, such as a fusing belt in pressure contact with a pressure roller, fusing roller in contact with a pressure belt, or other like systems.

Aspects of the present disclosure relate to a photoconductor containing an optional supporting substrate, a photogenerating layer comprised of a titanyl phthalocyanine, especially Type V titanyl phthalocyanine, and an alkyltriol, especially glycerol (1,2,3-propanetriol), and at least one charge transport layer, such as for example from 1 to about 7 layers, from 1 to about 4 layers, from 1 to 2 layers, and more specifically, one charge transport layer comprised of at least one charge transport component, wherein the at least one charge transport component is, for example, comprised of aryl amine molecules of the formula

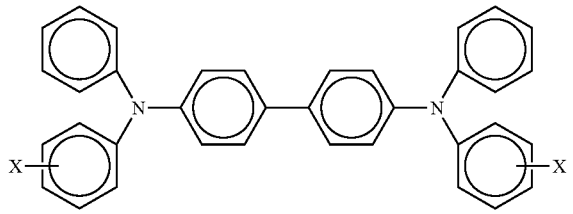

wherein X is a suitable substituent like alkyl, alkoxy, aryl, a halogen, or mixtures thereof, and more specifically, wherein the photogenerating layer contains a titanyl phthalocyanine prepared by dissolving a Type I titanyl phthalocyanine in a solution comprising a trihaloacetic acid and an alkylene halide; adding the mixture comprising the dissolved Type I titanyl phthalocyanine to a solution comprising an alcohol and an alkylene halide thereby precipitating a Type Y titanyl phthalocyanine; and treating the Type Y titanyl phthalocyanine with a monohalobenzene; a photoconductor comprised in sequence of a substrate, a photogenerating layer thereover, a titanyl phthalocyanine, especially Type V titanyl phthalocyanine, and alkyltriol, wherein alkyl contains, for example, from 3 to about 25 carbon atoms, and more specifically, from about 3 to about 8 carbon atoms, and a charge transport layer comprised of amines of the formula

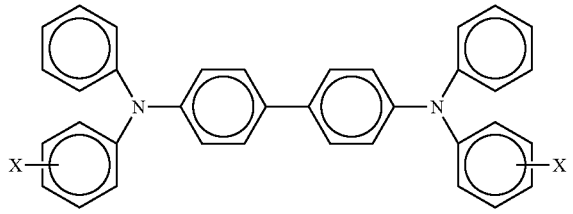

wherein X is a suitable hydrocarbon substituent like alkyl, alkoxy, aryl, substituted derivatives thereof, and mixtures thereof; or a halogen and mixtures of a halogen, and a suitable hydrocarbon; and/or hole transport molecules of the formula/structure

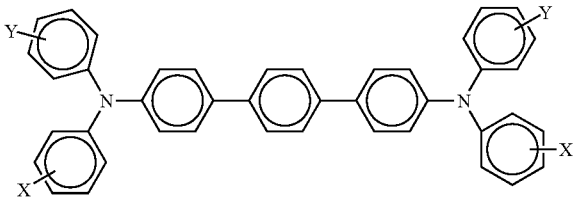

wherein X and Y are independently a suitable hydrocarbon like alkyl, alkoxy, aryl, mixtures thereof, and substituted derivatives thereof; a halogen, or mixtures thereof; and more specifically, wherein the photogenerating layer contains an alkyltriol, titanyl phthalocyanine Type V prepared by dissolving a Type I titanyl phthalocyanine in a solution comprising a trihaloacetic acid and an alkylene halide; adding the mixture to a solution comprising an alcohol and an alkylene halide thereby precipitating a Type Y titanyl phthalocyanine; and contacting the Type Y titanyl phthalocyanine with a monohalobenzene, and optionally, wherein the at least one charge transport layer includes an antioxidant; a photoconductor comprised of a substrate, a photogenerating layer comprised of Type V titanyl phthalocyanine, a resin binder, and an alkyltriol compound, and a plurality of charge transport layers wherein the plurality comprises at least one charge layer transport comprised of at least one aryl amine component; a photoconductor comprised of a substrate, a photogenerating layer, and wherein the photogenerating layer contains a titanyl phthalocyanine Type V and an alkyltriol, that is where the triol represents at least three hydroxyl groups, and more specifically, where the hydroxyl groups are attached to each of three adjacent carbon atoms of the alkyl chain (while not being desired to be limited by theory it is believed that the alkyltriol may stabilize the crystal structure of the titanyl phthalocyanine pigment, especially the high sensitivity titanyl phthalocyanine Type V form, through a chelation effect on the pigment crystal surface); a photoconductive member with a photogenerating layer of a thickness of from about 0.1 to about 11 microns; at least one transport layer each of a thickness of from about 1 to about 100 microns; a member wherein the photogenerating layer contains the photogenerating pigment present in an amount of from about 20 to about 80 weight percent; a member wherein the thickness of the photogenerating layer is from about 0.1 to about 4 microns; a member wherein the photogenerating layer contains a polymer binder; a member wherein the photogenerating layer binder is present in an amount of from about 20 to about 80 percent by weight, and wherein the total of all layer components is about 100 percent; a member wherein the photogenerating component is Type V titanyl phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; a photoconductor wherein the photogenerating resinous binder is selected from the group consisting of polyesters, polyacetals, polyvinyl butyrals, polycarbonates, polyarylates, polystyrene-b-polyvinyl pyridine, polyvinyl chloride-co-vinyl acetate-co-maleic acid, and polyvinyl formulas; a photoconductor containing a charge transport layer comprising aryl amine hole transport molecules of the formula

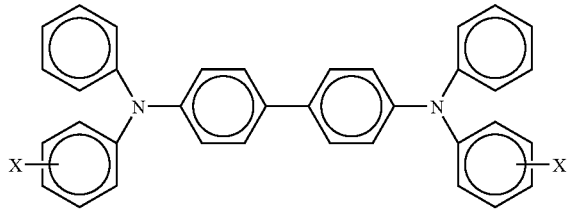

wherein the X substituent, which can be located in the para or meta positions, is selected from the group consisting of at least one of alkyl, alkoxy, substituted alkyl, substituted alkoxy, and halogen; an imaging member wherein alkyl and alkoxy contain from about 1 to about 15 carbon atoms; an imaging member wherein alkyl contains from about 1 to about 5 carbon atoms; an imaging member wherein alkyl is methyl; an imaging member wherein each of or at least one of the charge transport layers comprises

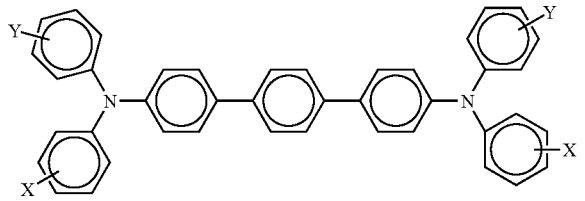

wherein X and Y are independently a suitable hydrocarbon like alkyl, alkoxy, aryl, substituted alkyl, substituted alkoxy, or substituted aryl; a halogen such as fluoride, chloride, bromide or iodide, or mixtures thereof; a photoconductive imaging member wherein for the charge transport layer there is selected in a suitable effective amount hole transport molecules of a terphenyl amine selected from the group consisting of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, and mixtures thereof; a photoconductive imaging member comprised of a supporting substrate, and thereover a layer comprised of titanyl phthalocyanine Type V photogenerating pigments, glycerol, and a plurality of charge transport layers; a member wherein the photogenerating layer is situated between the substrate and the charge transport; a member wherein the charge transport layer is situated between the substrate and the photogenerating layer; a member wherein the photogenerating layer is of a thickness of from about 0.1 to about 50 microns; a member wherein the photogenerating component amount is from about 20 weight percent to about 90 weight percent, and wherein the photogenerating pigment is optionally dispersed in from about 10 weight percent to about 80 weight percent of a polymer binder; a member wherein the thickness of the photogenerating layer is from about 0.2 to about 10 microns; a member wherein the photogenerating and charge transport layer components are contained in a polymer binder; a member wherein the binder is present in an amount of from about 35 to about 95 percent by weight, and wherein the total of the layer components is about 100 percent; an imaging member with a blocking layer contained as a coating on a substrate, and an adhesive layer coated on the blocking layer; and a color imaging method which comprises generating an electrostatic latent image on the imaging member, developing the latent image, transferring, and fixing the developed electrostatic image to a suitable substrate.

The photogenerating layer in embodiments is comprised of an alkyltriol, a polymer or resin binder, and high photosensitivity titanyl phthalocyanines prepared as illustrated herein, and in copending application U.S. application Ser. No. 10/992,500, U.S. Publication No. 2006010524, the disclosure of which is totally incorporated herein by reference. In embodiments, the Type V phthalocyanine can be generated by dissolving Type I titanyl phthalocyanine in a solution comprising a trihaloacetic acid and an alkylene halide; adding the resulting mixture comprising the dissolved Type I titanyl phthalocyanine to a solution comprising an alcohol and an alkylene halide thereby precipitating a Type Y titanyl phthalocyanine; and treating the resulting Type Y titanyl phthalocyanine with monochlorobenzene.

With further respect to the titanyl phthalocyanines selected for the photogenerating layer, such phthalocyanines exhibit a crystal phase that is distinguishable from other known titanyl phthalocyanine polymorphs, and are designated as Type V polymorphs prepared by converting a Type I titanyl phthalocyanine to a Type V titanyl phthalocyanine pigment. The processes include converting a Type I titanyl phthalocyanine to an intermediate titanyl phthalocyanine, which is designated as a Type Y titanyl phthalocyanine, and then subsequently converting the Type Y titanyl phthalocyanine to a Type V titanyl phthalocyanine.

In one embodiment, the Type V titanyl phthalocyanine process comprises (a) dissolving a Type I titanyl phthalocyanine in a suitable solvent; (b) adding the solvent solution comprising the dissolved Type I titanyl phthalocyanine to a quenching solvent system to precipitate an intermediate titanyl phthalocyanine (designated as a Type Y titanyl phthalocyanine); and (c) treating the resultant Type Y phthalocyanine with a halo, such as, for example, monochlorobenzene, to obtain a resultant high sensitivity titanyl phthalocyanine, which is designated herein as a Type V titanyl phthalocyanine. In another embodiment, prior to treating the Type Y phthalocyanine with a halo, such as monochlorobenzene, the Type Y titanyl phthalocyanine may be washed with various solvents including, for example, water, and/or methanol. The quenching solvents system to which the solution comprising the dissolved Type I titanyl phthalocyanine is added comprises, for example, an alkyl alcohol and an alkylene halide. These processes provide a titanyl phthalocyanine having a crystal phase distinguishable from other known titanyl phthalocyanines, and is distinguishable from, for example, Type IV titanyl phthalocyanines in that a Type V titanyl phthalocyanine exhibits an X-ray powder diffraction spectrum having four characteristic peaks at 9.0°, 9.6°, 24.0°, and 27.2°, while Type IV titanyl phthalocyanines typically exhibit only three characteristic peaks at 9.6°, 24.0°, and 27.2°.

A number of Type I titanyl phthalocyanines may be selected for the generation of the Type V titanyl phthalocyanine, such as the Type Is prepared as illustrated in U.S. Pat. Nos. 5,153,094; 5,166,339; 5,189,155; and 5,189,156, the disclosures of which are totally incorporated herein by reference. More specifically, a Type I titanyl phthalocyanine may be prepared, in embodiments, by the reaction of $DI^3$ (1,3-diiminoisoindolene) and tetrabutoxide in the presence of 1-chloronaphthalene solvent, whereby there is obtained a crude Type I titanyl phthalocyanine, which is subsequently purified up to about a 99.5 percent purity by washing with, for example, dimethylformamide.

Also, for example, a Type I titanyl phthalocyanine can be prepared by i) the addition of 1 part titanium tetrabutoxide to a stirred solution of from about 1 part to about 10 parts, and in embodiments about 4 parts of 1,3-diiminoisoindolene; ii) relatively slow application of heat using an appropriate sized heating mantle at a rate of about 1° per minute to about 100 per minute and, in embodiments, about 5° per minute until refluxing occurs at a temperature of about 130° C. to about 180° C. (all temperatures are in Centigrade unless otherwise indicated); iii) removal and collection of the resulting distillate, which was shown by NMR spectroscopy to be butyl alcohol, in a dropwise fashion using an appropriate apparatus, such as a Claisen Head condenser, until the temperature of the reactants reaches from 190° C. to about 230° C., and in embodiments, about 200° C.; iv) continued stirring at the reflux temperature for a period of about ½ hour to about 8 hours, and in embodiments, about 2 hours; v) cooling of the reactants to a temperature of about 130° C. to about 180° C., and in embodiments, about 160° C. by removal of the heat source; vi) filtration of the flask contents through, for example, an M-porosity (10 to 15 microns) sintered glass funnel which was preheated using a solvent, which is capable of raising the temperature of the funnel to about 150° C., for example, boiling N,N-dimethylformamide in an amount sufficient to completely cover the bottom of the filter funnel so as to prevent blockage of said funnel; vii) washing the resulting purple solid by slurrying the solid in portions of boiling DMF either in the funnel or in a separate vessel in a ratio of about 1 to about 10, and preferably about 3 times the volume of the solid being washed, until the hot filtrate became light blue in color; viii) cooling and further washing the solid of impurities by slurrying the solid in portions of N,N-dimethylformamide at room temperature, about 25° C., approximately equivalent to about three times blue in color; ix) washing the solid of impurities by slurrying the solid in portions of an organic solvent, such as methanol, acetone, water, and the like, and in this embodiment, methanol, at room temperature (about 25° C.) approximately equivalent to about three times the volume of the solid being washed until the filtrate became light blue in color; x) oven drying the purple solid in the presence of a vacuum or in air at a temperature of from about 25° C. to about 200° C., and in embodiments at about 70° C., for a period of from about 2 hours to about 48 hours, and in embodiments, for about 24 hours, thereby resulting in the isolation of a shiny purple solid, which was identified as being Type I titanyl phthalocyanine by its X-ray powder diffraction trace.

In a process embodiment for preparing a high sensitivity phthalocyanine in accordance with the present disclosure, a Type I titanyl phthalocyanine is dissolved in a suitable solvent. In embodiments, a Type I titanyl phthalocyanine is dissolved in a solvent comprising a trihaloacetic acid and an alkylene halide. The alkylene halide comprises, in embodiments, from about one to about six carbon atoms. An example of a suitable trihaloacetic acid includes, but is not limited to, trifluoroacetic acid. In one embodiment, the solvent for dissolving a Type I titanyl phthalocyanine comprises trifluoroacetic acid and methylene chloride. In embodiments, the trihaloacetic acid is present in an amount of from about one volume part to about 100 volume parts of the solvent, and the alkylene halide is present in an amount of from about one volume part to about 100 volume parts of the solvent. In one embodiment, the solvent comprises methylene chloride and trifluoroacetic acid in a volume-to-volume ratio of about 4 to 1. The Type I titanyl phthalocyanine is dissolved in the solvent by stirring for an effective period of time, such as, for example, for about 30 seconds to about 24 hours, at room temperature. The Type I titanyl phthalocyanine is dissolved by, for example, stirring in the solvent for about one hour at room temperature (about 25° C.). The Type I titanyl phthalocyanine may be dissolved in the solvent in either air or in an inert atmosphere (argon or nitrogen).

The Type I titanyl phthalocyanine in embodiments can be converted to an intermediate titanyl phthalocyanine Type Y prior to conversion to the high sensitivity titanyl phthalocyanine pigment. For example, to obtain the intermediate form, which is designated as a Type Y titanyl phthalocyanine, the dissolved Type I titanyl phthalocyanine is added to a quenching system comprising an alkyl alcohol, alkyl including, for example, carbon chain lengths of from about 1 to about 12 carbon atoms, and alkylene halides, such as an alkylene chloride. Adding the dissolved Type I titanyl phthalocyanine to the quenching system or quenching mixture causes the Type Y titanyl phthalocyanine to precipitate. Materials suitable as the alkyl alcohol component of the quenching system include, but are not limited to, methanol, ethanol, propanol, butanol, and the like. In embodiments, the alkylene chloride component of the quenching system comprises from about one to about six carbon atoms. In embodiments, the quenching system comprises methanol and methylene chloride. The quenching system comprises an alkyl alcohol to alkylene chloride ratio of from about 1/4 to about 4/1 (v/v). In other embodiments, the ratio of alkyl alcohol to alkylene chloride is from about 1/1 to about 3/1 (v/v). In an embodiment, the quenching system comprises methanol and methylene chloride in a ratio of about 1/1 (v/v). In another embodiment, the quenching system comprises methanol and methylene chloride in a ratio of about 3/1 (v/v). In embodiments, the dissolved Type I titanyl phthalocyanine is added to the quenching system at a rate of from about 1 milliliter/minute to about 100 milliliters/minute, and the quenching system is maintained at a temperature of from about 0° C. to about −25° C. during quenching. In a further embodiment, the quenching system is maintained at a temperature of from about 0° C. to about −25° C. for a period of from about 0.1 hour to about 8 hours after addition of the dissolved Type I titanyl phthalocyanine solution.

Following precipitation of the Type Y titanyl phthalocyanine, the precipitates may be washed with any suitable solution, including, for example, methanol, cold deionized water, hot deionized water, and the like. Generally, washing the precipitate will also be accompanied by filtration. A wet cake containing Type Y titanyl phthalocyanine and water is obtained with water content varying from about 30 to about 70 weight percent of the wet cake.

The Type V titanyl phthalocyanine is obtained by treating the obtained intermediate Type Y titanyl phthalocyanine with a halo, such as, for example, monochlorobenzene. The Type Y titanyl phthalocyanine wet cake may be redispersed in monochlorobenzene, filtered and oven-dried at a temperature of from about 60° C. to about 85° C. to provide the resultant Type V titanyl phthalocyanine. The monochlorobenzene treatment may occur over a period of about 1 hour to about 24 hours. In one embodiment, the monochlorobenzene treatment is accomplished for a period of about five hours.

A titanyl phthalocyanine obtained in accordance with processes of the present disclosure, which is designated as a Type V titanyl phthalocyanine, exhibits an X-ray powder diffraction spectrum distinguishable from other known titanyl phthalocyanine polymorphs. For example, the Type V titanyl phthalocyanine obtained exhibits in embodiments an X-ray diffraction spectrum having four characteristic peaks at 9.0°, 9.6°, 24.0°, and 27.2°; a particle size diameter of from about 10 nanometers to about 500 nanometers, and which particle size may be controlled or affected by the quenching rate when adding the dissolved Type I titanyl phthalocyanine to the quenching system and the composition of the quenching system.

Generally, the thickness of the photogenerating layer depends on a number of factors, including the thicknesses of the other layers and the amount of photogenerating material contained in the photogenerating layer. Accordingly, this layer can be of a thickness of, for example, from about 0.05 micron to about 30 microns, or to about 10 microns, and more specifically, from about 0.25 micron to about 2 microns when, for example, the photogenerating compositions are present in an amount of from about 30 to about 75 percent by weight. The maximum thickness of this layer in embodiments is dependent primarily upon factors, such as photosensitivity, electrical properties and mechanical considerations. The photogenerating layer binder resin includes those polymers as disclosed in U.S. Pat. No. 3,121,006, the disclosure of which is totally incorporated herein by reference, and is present in various suitable amounts, for example from about 10 to about 90 weight percent, and more specifically, from about 30 to about 70 weight percent, and which resin may be selected from a number of known polymers such as poly(vinyl butyral), poly(vinyl carbazole), polyesters, polycarbonates, polyarylates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, dichloroethane, tetrahydrofuran, dioxane, diethyl ether, dimethyl formamide, dimethyl acetamide, butyl acetate, ethyl acetate, methoxyethyl acetate, and the like.

In embodiments the photogenerating layer may contain in addition to the high sensitivity titanyl phthalocyanine other known photogenerating pigments like metal phthalocyanines, metal free phthalocyanines, alkylhydroxyl gallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium.

The alkyltriol, such as the glycerol additive. can be incorporated into the photogenerating layer by, for example, including this additive in the photogenerating dispersion, adding the additive to the formed photogenerating layer, and the like, in various effective amounts, such as for example, from about 0.05 to about 30, from about 0.1 to about 20, from about 0.1 to about 10, or from about 2 to about 10 weight percent based on the total amount of the components in the photogenerating layer, and which components include, for example, the photogenerating pigment or pigments, resin binder, and additive.

In embodiments, an alkyltriol compound in an amount, for example, of from about 0.01 to about 10 weight percent, and more specifically, from about 1 to about 5 weight percent, and which can be adsorbed onto the photogenerating pigment surface, is selected for the preparation of the photogenerating layer coating mixture to primarily stabilize the photogenerating material, such as titanyl phthalocyanine, against polymorphic (crystal structure) change in the polymer binder/solvent mixture in which the pigment is otherwise mixed. In particular embodiments, the alkyltriol is selected to first stabilize and disperse the photogenerating material, and thereafter the resultant dispersion of photogenerating material and alkyltriol is then added to a further solution of the film-forming polymer and solvent. Thus, for example, while the alkyltriol compound can be used to stabilize the TiOPC photogenerating pigment, it is desired in embodiments that the final composition include an alkyltriol compound and a film-forming polymer binder that in embodiments is free of hydroxyl groups and the photogenerating pigment.

Thus, for example, the photogenerating layer coating can be prepared by first preparing a mixture of the photogenerating pigment and the alkyltriol compound in a film-forming polymer binder, optionally in a solvent. Once the mixture is formed, whereby the photogenerating material is stabilized against polymorphic (crystal structure) change by the alkyltriol compound, the mixture can be added to the remaining bulk film-forming polymer and solvent to form the final photogenerating layer coating mixture. The solvents used in forming the first mixture and in forming the final mixture can be the same or different.

More specifically, there is generated a dispersion by milling the photogenerating pigment of a high sensitivity titanyl phthalocyanine, such as Type V titanyl phthalocyanine, a binder resin like a polycarbonate, and the alkyltriol in a solvent like tetrahydrafuran or monochlorobenzene using common milling equipment like an attritor, milling jar, dynomill, or the like, and applying the dispersion to, for example, the photoconductor substrate. The alkyltriol compound can be combined with the photogenerating material in any desired or suitable amount, although in embodiments the alkyltriol, like the glycerol compound, is combined with the photogenerating pigment in a lesser amount relative to the photogenerating material. For example, the alkyltriol compound can be present in an amount of from about 0.1 to about 10 percent by weight, and the photogenerating material can be present in an amount of from about 30 to about 70 percent by weight. A solvent can also be added in any desired amount. As a result, the final dried charge generating layer can include the photogenerating pigment, the polymeric film-forming polymer binder, and alkyltriol compound in various amounts to provide the desired functional effects. However, in embodiments, the photogenerating pigment is generally present in an amount of from about 10 to about 90 parts by weight, and more specifically, from about 30 to about 70 parts by weight; from about 90 to about 10 parts by weight, and yet more specifically, from about 70 to about 30 parts by weight of polymeric film-forming polymer binder; and from about 0.01 to about 20 parts by weight, and more specifically, from about 0.05 to about 10 parts by weight of alkyltriol compound. Also, in embodiments the alkyltriol three hydroxyl groups are located on three adjacent carbon atoms in the alkyl chain.

Examples of alkyltriols include 1,2,3-propanetriol, 1,2,3-butanetriol, 1,2,3-pentanetriol, 2,3,4-pentanetriol, 1,2,3-hexanetriol, 2,3,4-hexanetriol, 1,2,3-heptanetriol, 2,3,4-heptanetriol, 3,4,5-heptanetriol, 1,2,3-octanetriol, 2,3,4-octanetriol, and 3,4,5-octanetriol, mixtures thereof, and the like. Alkyl includes, for example, from 3 to about 20 carbon atoms, from 3 to about 15 carbon atoms, from 3 to about 8 carbon atoms, such as methyl, ethyl, propyl, butyl, pentyl, hexyl, heptyl, nonyl, and other known alkyl groups.

The thickness of the photoconductor substrate layer is, in embodiments, dependant on a number of factors, including economical considerations, components in each layer, electrical characteristics, and the like, thus this layer may be of substantial thickness, for example over 3,000 microns, from about 100 to about 1,000 microns, or from about 300 to about 700 microns, or of a minimum thickness. In embodiments, the thickness of this layer is from about 75 microns to about 300 microns, or from about 100 microns to about 150 microns.

The photoconductor substrate may be opaque or substantially transparent, and may comprise any suitable material. Accordingly, the substrate may comprise a layer of an electrically nonconductive, or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum photoconductor, this layer may be of a substantial thickness of, for example, up to many centimeters or of a minimum thickness of less than a millimeter. Similarly, a flexible belt may be of a substantial thickness, for example about 250 micrometers, or of a minimum thickness of less than about 50 micrometers.

Illustrative examples of substrates are as illustrated herein, and can comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example, polycarbonate materials commercially available as MAKROLON®.

Various resins can be used as electrically nonconducting materials, including, but not limited to, polyesters, polycarbonates, polyamides, polyurethanes, and the like. Examples of suitable substrate materials include, but are not limited to, a commercially available biaxially oriented polyester known as MYLAR™, available from E.I. DuPont de Nemours & Company, MELINEX™, available from ICI Americas Inc., or HOSTAPHAN™, available from American Hoechst Corporation. Other materials of which the substrate may be comprised include polymeric materials, such as polyvinyl fluoride, available as TEDLAR™ from E.I. DuPont de Nemours & Company, polyethylene and polypropylene, available as MARLEX™ from Phillips Petroleum Company, polyphenylene sulfide, RYTON™, available from Phillips Petroleum Company, and polyimides, available as KAPTON™ from E.I. DuPont de Nemours & Company. The photoreceptor can also be coated on an insulating plastic drum, provided a conducting ground plane has previously been coated on its surface as described above. Such substrates can either be seamed or seamless.

When a conductive substrate is employed, any suitable conductive material can be selected. For example, the conductive material can include, but is not limited to, metal flakes, powders or fibers, such as aluminum, titanium, nickel, chromium, brass, gold, stainless steel, carbon black, graphite, or the like, in a binder resin including metal oxides, sulfides, silicides, quaternary ammonium salt compositions, conductive polymers, such as polyacetylene or its pyrolysis, and molecular doped products, charge transfer complexes, polyphenyl silane, and molecular doped products from polyphenyl silane. A conducting plastic drum can be used as well as the preferred conducting metal drum made from a material, such as aluminum.

Suitable charge transport components to, for example, allow the transfer of charge, especially holes, include a number of known materials, examples of which are aryl amines of the following formula, and which layer generally is of a thickness of from about 5 microns to about 75 microns, and more specifically, of a thickness of from about 10 microns to about 40 microns,

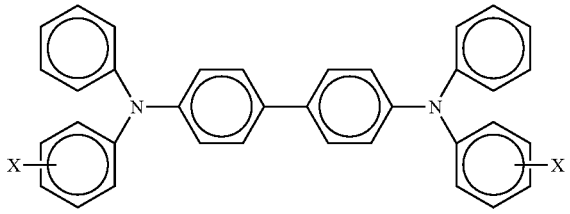

wherein X is at least one of alkyl, alkoxy, aryl, substituted derivatives thereof, or a halogen, and especially those substituents selected from the group consisting of Cl and $CH_3$; molecules of the following formula

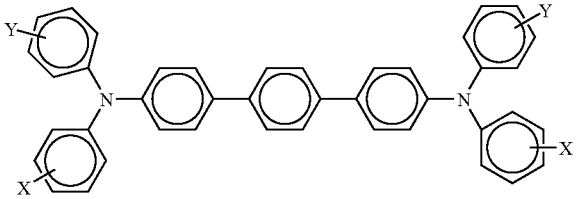

wherein X and Y are independently alkyl, alkoxy, aryl, a halogen, or mixtures thereof. Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, and the like. Other known charge transport layer molecules can be selected, reference for example U.S. Pat. Nos. 4,921,773 and 4,464,450, the disclosures of which are totally incorporated herein by reference.

The charge transport layer or layers, and more specifically, a first charge transport in contact with the photogenerating layer, and thereover a top or second charge transport overcoating layer may comprise the illustrated charge transporting small molecules dissolved or molecularly dispersed in a film forming electrically inert polymer, such as a polycarbonate. In embodiments, dissolved refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale.

Examples of hole transporting molecules for the charge transport layers are as indicated herein, and include, for example, known hole transport components; aryl amines such as N,N'-diphenyl-N,N'-bis(3-methylphenyl)-(1,1'-biphenyl)-4,4'-diamine, N,N'-diphenyl-N,N-bis(4-methylphenyl)-(1,1'-biphenyl)-4,4'-diamine, N,N'-diphenyl-N,N-bis(2-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)- N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, optionally mixtures thereof, and the like. In embodiments, to minimize or avoid cycle-up in equipment, such as printers, with high throughput, it is sometimes desirable that the charge transport layer be substantially free (less than about two percent) of di or triamino-triphenyl methane. The electrically active small molecule charge transporting compounds are dissolved or molecularly dispersed in electrically inactive polymeric film forming materials. A small molecule charge transporting compound that permits injection of holes into the photogenerating layer with high efficiency, and transports them across the charge transport layer with short transit times specifically includes N,N'-diphenyl-N,N'-bis(3-methylphenyl)-(1,1'-biphenyl)-4,4'-diamine, N,N'-diphenyl-N,N-bis(4-methylphenyl)-(1,1'-biphenyl)-4,4'-diamine, N,N'-diphenyl-N,N-bis(2-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, or N,N'-diphenyl-N,N'-bis(3-chlorophenyl)-[p-terphenyl]-4,4"-diamine. When desired, the charge transport material in the charge transport layer may comprise a polymeric charge transport material or a combination of a small molecule charge transport material and a polymeric charge transport material.

The charge transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be maintained from about 2:1 to 200:1, and in some instances as great as 400:1. The charge transport layer is substantially nonabsorbing to visible light or radiation in the region of intended use, but is electrically "active" in that it allows the injection of photogenerated holes from the photoconductive layer, that is the photogenerating layer, and allows these holes to be transported through itself to selectively discharge a surface charge on the surface of the active layer.

The thickness of the continuous charge transport overcoat layer selected depends, for example, upon the abrasiveness of the charging (bias charging roll), cleaning (blade or web), development (brush), transfer (bias transfer roll), and the like in the system employed, and can be up to about 10 micrometers. In embodiments, this thickness for each layer is from about 1 micrometer to about 5 micrometers. Various suitable and conventional methods may be used to mix, and thereafter apply the overcoat layer coating mixture to the photogenerating layer. Typical application techniques include spraying, dip coating, roll coating, wire wound rod coating, and the like. Drying of the deposited coating may be effected by any suitable conventional technique such as oven drying, infrared radiation drying, air drying, and the like. The dried overcoating layer of this disclosure should transport holes during imaging, and should not have too high a free carrier concentration. Free carrier concentration in the overcoat increases the dark decay.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof. In embodiments, electrically inactive binders are comprised of polycarbonate resins with, for example, a molecular weight of from about 20,000 to about 100,000, and more specifically, with a molecular weight $M_w$ of from about 50,000 to about 100,000. Examples of polycarbonates are poly(4,4'-isopropylidene-diphenylene)carbonate (also referred to as bisphenol-A-polycarbonate), poly(4,4'-cyclohexylidinediphenylene)carbonate (also referred to as bisphenol-Z polycarbonate), poly(4,4'-isopropylidene-3,3'-dimethyl-diphenyl)carbonate (also referred to as bisphenol-C-polycarbonate), and the like.

The optional hole blocking or undercoat layer for the imaging members of the present disclosure can contain a number of components, including known hole blocking components, such as amino silanes, doped metal oxides, TiSi, a metal oxide like titanium, chromium, zinc, tin, and the like; a mixture of phenolic compounds and a phenolic resin, or a mixture of two phenolic resins; and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylenediisopropylidene)bisphenol), S (4,4'-sulfonyldiphenol), Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion, a phenolic compound and dopant are added followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM® 29159 and 29101 (available from OxyChem Company), and DURITE® 97 (available from Borden Chemical), formaldehyde polymers with ammonia, cresol and phenol, such as VARCUM® 29112 (available from OxyChem Company), formaldehyde polymers with 4,4'-(1-methylethylidene)bisphenol, such as VARCUM® 29108 and 29116 (available from OxyChem Company), formaldehyde polymers with cresol and phenol, such as VARCUM® 29457 (available from OxyChem Company), DURITE® SD-423A, SD-422A (available from Borden Chemical), or formaldehyde polymers with phenol and p-tert-butylphenol, such as DURITE® ESD 556C (available from Border Chemical).

The optional hole blocking layer may be applied to the substrate. Any suitable and conventional blocking layer capable of forming an electronic barrier to holes between the adjacent photoconductive layer (or electrophotographic imaging layer) and the underlying conductive surface of the substrate may be selected.

In embodiments, a suitable known adhesive layer, usually situated between the hole blocking layer and the photogenerating layer, can be selected for the photoconductor. Typical adhesive layer materials include, for example, polyesters, polyurethanes, and the like. The adhesive layer thickness can vary, and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying and the like.

As adhesive layer component examples, there can be selected various known substances inclusive of polyesters, copolyesters, polyamides, poly(vinyl butyral), poly(vinyl alcohol), polyurethane, and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure, further desirable electrical and optical properties.

Examples of components or materials optionally incorporated into the charge transport layers or at least one charge transport layer to, for example, enable improved lateral charge migration (LCM) resistance include hindered phenolic antioxidants such as tetrakis methylene (3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20, from about 1 to about 10, or from about 3 to about 8 weight percent.

Primarily for purposes of brevity, the examples of each of the substituents and each of the components/compounds/molecules, polymers, (components) for each of the substrate, charge transport, resin binders, hole blocking, and adhesive layers specifically disclosed herein are not intended to be exhaustive. Thus, a number of components, polymers, formulas, structures, and R group or substituent examples and carbon chain lengths not specifically disclosed or claimed are intended to be encompassed by the present disclosure and claims. For example, these substituents include suitable known groups, such as aliphatic and aromatic hydrocarbons with various carbon chain lengths, and which hydrocarbons can be substituted with a number of suitable known groups and mixtures thereof. Also, the carbon chain lengths are intended to include all numbers between those disclosed or claimed or envisioned, thus from 1 to about 20 carbon atoms, and from 6 to about 42 carbon atoms includes 1, 2, 3, 4, 5, 6, 7, 8, 9, 10, 11, 12, 13, 14, 15 up to 42, or more. Similarly, the thickness of each of the layers, the examples of components in each of the layers, the amount ranges of each of the components disclosed and claimed is not exhaustive, and it is intended that the present disclosure and claims encompass other suitable parameters not disclosed, or that may be envisioned.

The following Examples are being submitted to illustrate embodiments of the present disclosure. These Examples are intended to be illustrative only and are not intended to limit the scope of the present disclosure. Also, parts and percentages are by weight unless otherwise indicated. Comparative Examples and data are also provided.

EXAMPLE I

Preparation of Type I Titanyl Phthalocyanine:

A Type I titanyl phthalocyanine (TiOPc) was prepared as follows. To a 300 milliliter three-necked flask fitted with mechanical stirrer, condenser and thermometer maintained under an argon atmosphere were added 3.6 grams (0.025 mole) of 1,3-diiminoisoindoline, 9.6 grams (0.075 mole) of o-phthalonitrile, 75 milliliters (80 weight percent) of N-methylpyrrolidone and 7.11 grams (0.025 mole) of titanium tetrapropoxide (all obtained from Aldrich Chemical Company except phthalonitrile which was obtained from BASF). The resulting mixture (20 weight percent of solids) was stirred and warmed to reflux (about 198° C.) for 2 hours. The resultant black suspension was cooled to about 150° C., and then was filtered by suction through a 350 milliliter, M-porosity sintered glass funnel, which had been preheated with boiling dimethyl formamide (DMF). The solid Type I TiOPc product resulting was washed with two 150 milliliter portions of boiling DMF, and the filtrate, initially black, became a light blue-green color. The solid was slurried in the funnel with 150 milliliters of boiling DMF and the suspension was filtered. The resulting solid was washed in the funnel with 150 milliliters of DMF at 25° C., and then with 50 milliliters of methanol. The resultant shiny purple solid was dried at 70° C. overnight to yield 10.9 grams (76 percent) of pigment, which was identified as Type I TiOPc on the basis of its X-ray powder diffraction trace. Elemental analysis of the product indicated C, 66.54; H, 2.60; N, 20.31; and Ash ($TiO_2$), 13.76. TiOPc requires (theory) C, 66.67; H, 2.80; N, 19.44; and Ash, 13.86.

A Type I titanyl phthalocyanine can also be prepared in 1-chloronaphthalene as follows. A 250 milliliter three-necked flask fitted with mechanical stirrer, condenser and thermometer maintained under an atmosphere of argon was charged with 1,3-diiminoisoindolene (14.5 grams), titanium tetrabutoxide (8.5 grams), and 75 milliliters of 1-chloronaphthalene (ClNp). The mixture was stirred and warmed. At 140° C. the mixture turned dark green and began to reflux. At this time, the vapor (which was identified as n-butanol by gas chromatography) was allowed to escape to the atmosphere until the reflux temperature reached 200° C. The reaction was maintained at this temperature for two hours then was cooled to 150° C. The product was filtered through a 150 milliliter M-porosity sintered glass funnel, which was preheated to approximately 150° C. with boiling DMF, and then washed thoroughly with three portions of 150 milliliters of boiling DMF, followed by washing with three portions of 150 milliliters of DMF at room temperature, and then three portions of 50 milliliters of methanol, thus providing 10.3 grams (72 percent yield) of a shiny purple pigment, which was identified as Type I TiOPc by X-ray powder diffraction (XRPD).

EXAMPLE II (FIG. 2)

Preparation of Type V Titanyl Phthalocyanine:

Fifty grams of TiOPc Type I were dissolved in 300 milliliters of a trifluoroacetic acid/methylene chloride (1/4, volume/volume) mixture for 1 hour in a 500 milliliter Erlenmeyer flask with magnetic stirrer. At the same time, 2,600 milliliters of methanol/methylene chloride (1/1, volume/volume) quenching mixture was cooled with a dry ice bath for 1 hour in a 3,000 milliliter beaker with magnetic stirrer, and the final temperature of the mixture was about −25° C. The resulting TiOPc solution was transferred to a 500 milliliter addition funnel with a pressure-equalization arm, and added into the cold quenching mixture over a period of 30 minutes. The mixture obtained was then allowed to stir for an additional 30 minutes, and subsequently hose-vacuum filtered through a 2,000 milliliter Buchner funnel with fibrous glass frit of 4 to 8 μm in porosity. The pigment resulting was then well mixed with 1,500 milliliters of methanol in the funnel, and vacuum filtered. The pigment was then well mixed with 1,000 milliliters of hot water (>90° C.), and vacuum filtered in the funnel four times. The pigment was then well mixed with 1,500 milliliters of cold water, and vacuum filtered in the funnel. The final water filtrate was measured for conductivity, which was below 10 μS. The resulting wet cake contained approximately 50 weight percent of water. A small portion of the wet cake was dried at 65° C. under vacuum and a blue pigment was obtained. A representative XRPD of this pigment after quenching with methanol/methylene chloride was identified by XRPD as Type Y titanyl phthalocyanine.

The remaining portion of the wet cake was redispersed in 700 grams of monochlorobenzene (MCB) in a 1,000 milliliter bottle and rolled for an hour. The dispersion was vacuum filtered through a 2,000 milliliter Buchner funnel with a fibrous glass frit of 4 to 8 μm in porosity over a period of two hours. The pigment was then well mixed with 1,500 milliliters of methanol and filtered in the funnel twice. The final pigment was vacuum dried at 60° C. to 65° C. for two days. Approximately 45 grams of the pigment were obtained. The XRPD of the resulting pigment after the MCB conversion was designated as a Type V titanyl phthalocyanine. The Type V had an X-ray diffraction pattern having characteristic diffraction peaks at a Bragg angle of 2Θ ±0.2° at about 9.0°, 9.6°, 24.0°, and 27.2°.

COMPARATIVE EXAMPLE 1

Preparation of Titanyl Phthalocyanine Photoconductors:

An imaging or photoconductive member incorporating a TiOPc Type V pigment was prepared in accordance with the following procedure. A TiOPc dispersion was prepared by ball milling 0.60 gram of TiOPc pigment (obtained from Example II), 0.113 gram of IUPILON® 200 (PC-Z 200) polycarbonate, poly(4,4'-cyclohexylidinediphenylene)carbonate with $M_w$ of about 55,000, available from Mitsubishi Gas Chemical Corp., and 11.2 grams of tetrahydrofuran in a 30 milliliter glass bottle containing 70 grams of approximately ⅛ inch stainless steel balls. Four separate bottles of this photogenerating dispersion were prepared; each bottle was rolled in the roll mill for different durations at 2, 4, 6, and 8 hours, respectively. Four grams of the milled TiOPc Type V pigment dispersion from each bottle was transferred to another bottle and further diluted with a solution of 3 grams of tetrahydrofuran and 0.19 gram of PC-Z 200 to form a final coating dispersion selected for the preparation of the charge generator layers.

The resulting TiOPc Type V dispersion was coated using a Bird's bar (0.00025 inch gap) onto a titanium metallized polyethylene naphthalate sheet, which had a 400 Å silane of (3-aminopropylmethyldiethoxysilane) blocking layer, thereover, and a 200 Å polyester. The coated device was dried at 100° C. for 10 minutes. A transport layer solution was prepared by mixing 6.34 grams of N,N'-diphenyl-N,N'-bis(3-methylphenyl)-1,1-biphenyl-4,4'-diamine, 6.34 grams of polycarbonate resin (available as MAKROLON® 5705 from Bayer A. G.), and 72 grams of methylene chloride. The transport solution was coated onto the above photogenerating layer using a Bird's bar of 5 mil gap. The resulting members were dried at 120° C. in a forced air oven for 1 minute. The final dried thickness of the transport layer was about 29 microns. Hence, four imaging members were fabricated from the TiOPc dispersions that had been milled at 2, 4, 6 and 8 hours, respectively.

EXAMPLE III

Preparation of Titanyl Phthalocyanine Imaging Members Containing Glycerol in Photogenerator Dispersions:

Photoconductive members were prepared by repeating the process of Comparative Example 1 except that the photogenerating layer dispersions were prepared with an additional 0.003 gram of glycerol (1,2,3-propanetriol) added into the photogenerating mixture composition. Four bottles of the glycerol doped dispersions were prepared. Four photoconductors were obtained with the glycerol doped dispersions which were milled at 2, 4, 6 and 8 hours, respectively.

COMPARATIVE EXAMPLE 2

Preparation of Titanyl Phthalocyanine Imaging Members Containing Glycol in Photogenerator Dispersions:

Photoconductive imaging members were prepared by repeating the process of Comparative Example 1 except that the photogenerating layer dispersions were prepared with an additional 0.003 gram of diethylene glycol (2-hydroxylethyl ether) added into the photogenerating composition. Four bottles of diethylene glycol doped dispersions were prepared. Four imaging members were obtained for doped dispersions that were milled at 2, 4, 6 and 8 hours, respectively.

ELECTRICAL PROPERTY TESTING

Xerographic Evaluation of Imaging Members:

The xerographic electrical properties of the above prepared photoconductors were determined by known means, such as by charging the surfaces thereof with a corona discharge source until the surface potentials, as measured by a capacitively coupled probe attached to an electrometer, attained an initial value $V_0$ of about −800 volts. After resting for a 0.5 second in the dark, the charged members attained a surface potential of $V_{ddp}$, dark development potential. The photoconductive imaging members were then exposed to light from a filtered Xenon lamp with a 150 watt bulb, thereby inducing a photodischarge which resulted in a reduction of surface potential to a $V_{bg}$ value, background potential. The wavelength of the incident light was 780 nanometers, and the exposure energy of the incident light varied from 0 to 15 ergs/cm$^2$. The dark decay (D.D.) value was calculated according to the equation, $D.D.=2\times(V_0-V_{ddp})$. By plotting the surface potential against exposure energy, a photodischarge curve was constructed. The photosensitivity of the imaging member can be described in terms of $E_{1/2}$, (half-discharge exposure energy), that is the amount of exposure energy in erg/cm$^2$ required to achieve 50 percent photodischarge from the dark development potential. The results obtained for the photoconductive members fabricated in accordance with the above Examples are summarized in the following table.

| Example | Dispersion Milling Time (Hour) | Half-Discharge Exposure Energy $E_{1/2}$, erg/cm$^2$ |
|---|---|---|
| Comparative Ex. 1 | 2 | 0.95 |
| Comparative Ex. 1 | 4 | 1.15 |
| Comparative Ex. 1 | 6 | 3.27 |
| Comparative Ex. 1 | 8 | 2.97 |
| Comparative Ex. 2 | 2 | 1.39 |
| Comparative Ex. 2 | 4 | 1.56 |
| Comparative Ex. 2 | 6 | 2.17 |
| Comparative Ex. 2 | 8 | 3.38 |
| Example III | 2 | 0.89 |
| Example III | 4 | 0.93 |
| Example III | 6 | 1.03 |
| Example III | 8 | 1.01 |

The results demonstrate that a small amount of a suitable glycerol dopant has a substantial desirable impact in slowing down the degradation of photosensitivity with milling time, and which permits excellent operation latitudes in the preparation of dispersion. Although not limited by theory, it is speculated that the trihydroxyl groups on adjacent carbon atoms may be chelating to or adsorbing to certain sites of the Type V TiOPc that stabilizes the Type V pigment crystal against polymorphic change. Example III members containing glycerol, an alkyltriol, had $E_{1/2}$ values of about 0.9 to about 1 erg/cm$^2$ for all milling times and less than 13 percent change in photosensitivity was observed.

Comparative Example 1 members containing no dopant in the TiOPC photogenerator dispersion, showed $E_{1/2}$ values increasing more rapidly with milling time. A three fold increase in $E_{1/2}$ value for 8 hour milling indicates that the sensitivity had decreased to 1/3 of the initial photosensitivity observed for the 2 hour milling.

Comparative Example 2 members also showed a large increase in $E_1/2$ value with milling time. $E_{1/2}$ obtained for 8 hour milling dispersion was about 3.3 times that of Example III dispersion processed at the same duration. Although the dopant ethylene glycol in Comparative Example 2 contains two hydroxyl groups attached to non-adjacent carbon atoms, they do not appear to be as effective in stabilizing the Type V pigment crystal structure during milling.

OPTICAL ABSORPTION PROPERTY

In addition to measuring the change of photosensitivity TiOPc dispersion against milling time, optical measurement can be used to monitor the polymorphic (crystal structure) change of TiOPc pigment.

Optical absorption spectra of TiOPc imaging members were obtained using Shimadzu Model UV-160 spectrophotometer in the wavelength region from 400 to 1,000 nanometers. The variation of optical absorption spectrum with milling time provided some qualitative indication of polymorphic stability of TiOPc. For example, the shift of absorption peak position, or the change in the absorbance ratio of peak (800 nanometers)/tail (1,000 nanometers), would indicate a polymorphic change. High sensitivity TiOPc had a characteristic absorption peak at about 800 nanometers, and the absorbance ratio of peak (800 nanometers)/tail (1,000 nanometers) was usually greater than 5.

Example III members containing an alkyltriol, namely glycerol, showed stable optical absorption for all milling times. The absorption peak stayed at 810 nanometers, and the absorbance ratio remained in the range of from 6.8 to 7.5. For Comparative Example 1 members containing no glycerol dopant, the absorbance ratio started at 5 for 2 hour milling and degraded to about 1.6 for both 6 and 8 hour milling. This suggests polymorphic change occurred at longer milling times. Comparative Example 2 members containing an alkyldiol, glycol exhibited a low absorbance ratio of about 1.7 at 2 hours of milling time.

The optical absorption results, therefore, suggest that the glycerol doping for the Example III photoconductors enabled the preservation of a high absorbance ratio and a stable maximum peak high sensitivity for the TiOPc pigment over various milling times. However, both undoped and doped glycol (two hydroxyl groups) TiOPC containing photoconductors failed in this regard in that the glycol did not stabilize the TiOPC pigment, and the photosensitivity thereof degraded during the milling process.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a photogenerating layer, and at least one charge transport layer, and wherein said photogenerating layer is comprised of an alkyltriol and a titanyl phthalocyanine photogenerating pigment, and wherein said titanyl phthalocyanine is prepared by dissolving a Type I titanyl phthalocyanine in a solution comprising a trihaloacetic acid and an alkylene halide; adding said mixture comprising the dissolved Type I titanyl phthalocyanine to a solution comprising an alcohol and an alkylene halide thereby precipitating a Type Y titanyl phthalocyanine; and treating said Type Y titanyl phthalocyanine with a monohalobenzene; and wherein said photoconductor includes a supporting substrate.

2. A photoconductor in accordance with claim 1 wherein said solution comprising an alcohol and an alkylene halide has an alcohol to alkylene halide ratio of from about 1/4 (v/v) to about 4/1 (v/v), and said titanyl phthalocyanine is Type V titanyl phthalocyanine, and wherein the resulting Type V titanyl phthalocyanine has an X-ray diffraction pattern having characteristic diffraction peaks at a Bragg angle 2Θ ±0.2° at about 9°, 9.6°, 24°, and 27.2°, and wherein the photoconductor further contains a supporting substrate, and wherein said alkyltriol is selected from the group comprised of at least one of 1,2,3-propanetriol, 1,2,3-butanetriol, 1,2,3-pentanetriol, 2,3,4-pentanetriol, 1,2,3-hexanetriol, 2,3,4-hexanetriol, 1,2,3-heptanetriol, 2,3,4-heptanetriol, 3,4,5-heptanetriol, 1,2,3-octanetriol, 2,3,4-octanetriol, and 3,4,5-octanetriol.

3. A photoconductor in accordance with claim 1 wherein said monohalobenzene is monochlorobenzene and wherein said solution comprising an alcohol and an alkylene halide comprises methanol and methylene chloride, and wherein said photoconductor contains a supporting substrate.

4. A photoconductor in accordance with claim 1 wherein said pigment is titanyl phthalocyanine Type V prepared by dissolving a Type I titanyl phthalocyanine in a solution of trifluoroacetic acid and methylene chloride; precipitating a Type Y titanyl phthalocyanine by adding said solution of trifluoroacetic acid, methylene chloride and the Type I titanyl phthalocyanine to a solution of methanol and methylene chloride; washing said Type Y titanyl phthalocyanine; and converting the Type Y titanyl phthalocyanine to a Type V titanyl phthalocyanine by treating said Type Y titanyl phthalocyanine with monochlorobenzene, and wherein said alkyltriol is selected from at least one of the groups comprised of 1,2,3-propanetriol, 1,2,3-butanetriol, 1,2,3-pentanetriol, 2,3,4-pentanetriol, 1,2,3-hexanetriol, 2,3,4-hexanetriol, 1,2,3-heptanetriol, 2,3,4-heptanetriol, 3,4,5-heptanetriol, 1,2,3-octanetriol, 2,3,4-octanetriol, and 3,4,5-octanetriol.

5. A photoconductor in accordance with claim 1 wherein said pigment phthalocyanine is Type V titanyl phthalocyanine prepared by dissolving a Type I titanyl phthalocyanine pigment in a solution comprising a trihaloacetic acid and an alkylene chloride; quenching the resultant solution in a quenching mixture comprising an alcohol and an alkylene halide to precipitate an intermediate titanyl phthalocyanine pigment; and treating said intermediate titanyl phthalocyanine with monochlorobenzene.

6. A photoconductor in accordance with claim 1 wherein said alkyltriol is present in an amount of from about 0.01 to about 20 weight percent, and wherein said photoconductor contains a supporting substrate.

7. A photoconductor in accordance with claim 1 wherein said alkyltriol is present in an amount of from about 0.05 to about 10 weight percent.

8. A photoconductor in accordance with claim 1 wherein said alkyltriol contains at least three adjacent carbon atoms to which is bonded a hydroxyl group.

9. A photoconductor in accordance with claim 1 wherein said alkyltriol is selected from the group comprised of at least one of 1,2,3-propanetriol, 1,2,3-butanetriol, 1,2,3-pentanetriol, 2,3,4-pentanetriol, 1,2,3-hexanetriol, 2,3,4-hexanetriol, 1,2,3-heptanetriol, 2,3,4-heptanetriol, 3,4,5-heptanetriol, 1,2,3-octanetriol, 2,3,4-octanetriol, and 3,4,5-octanetriol.

10. A photoconductor in accordance with claim 9 wherein said alkyl contains from 3 to about 8 carbon atoms, said photogenerating layer pigment is comprised of Type V titanyl phthalocyanine, a binder, and said alkyltriol, and wherein said charge transport is comprised of hole transport molecules and a resin binder; and wherein at least one is from 1 to about 4 charge transport layers.

11. A photoconductor in accordance with claim 1 wherein said charge transport layer is comprised of at least one aryl amine of the formulas/structures

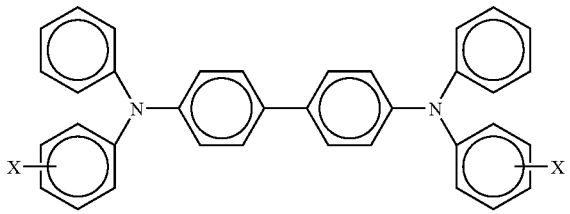

wherein X is alkyl, alkoxy, aryl, or a halogen; and

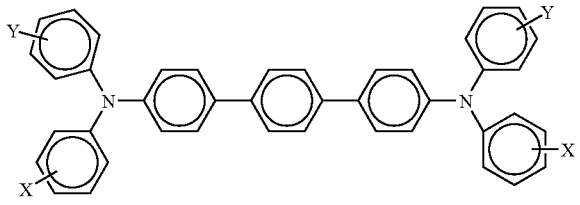

wherein each X and Y is alkyl, alkoxy, aryl, or halogen.

12. A photoconductor in accordance with claim 11 wherein said aryl amine is selected from the group consisting of N,N'-diphenyl-N,N-bis(3-methylphenyl)-(1,1'-biphenyl)-4,4'-diamine, N,N'-diphenyl-N,N-bis(4-methylphenyl)-(1,1'-biphenyl)-4,4'-diamine, N,N'-diphenyl-N,N-bis(2-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropyl phenyl)-[p-terphenyl]-4,4"-diamine, N,N"-bis(4-butylphenyl)-N,N'-bis-(2-ethyl-6-methylphenyl)-[p-terphenyl]-4,4"diamine, and N,N'-bis(4-butylphenyl)-N,N'-bis-(2,5-dimethylphenyl)-[p-terphenyl]-4,4"-diamine; wherein said substrate is present; and wherein said alkyltriol is selected from the group comprised of 1,2,3-propanetriol, 1,2,3-butanetriol, 1,2,3-pentanetriol, 2,3,4-pentanetriol, 1,2,3-hexanetriol, 2,3,4-hexanetriol, 1,2,3-heptanetriol, 2,3,4-heptanetriol, 3,4,5-heptanetriol, 1,2,3-octanetriol, 2,3,4-octanetriol, and 3,4,5-octanetriol.

13. A photoconductor in accordance with claim 1 further including in at least one of said charge transport layers an antioxidant comprised of a hindered phenolic and a hindered amine.

14. A photoconductor in accordance with claim 1 further including a hole blocking layer, and an adhesive layer.

15. A photoconductor in accordance with claim 1 wherein said substrate is a flexible belt, said photogenerating layer is situated between said at least one charge transport layer and a substrate, said at least one charge transport layer is from 1 to about 3, said alkyltriol is present in an amount of from about 0.05 to about 10 weight percent, said photogenerating layer and said charge transport layer each contain a resin binder, and wherein the photoconductor further includes a hole blocking layer and an adhesive layer situated between said substrate and said photogenerating layer; and wherein said alkyltriol is selected from the group comprised of 1,2,3-propanetriol, 1,2,3-butanetriol, 1,2,3-pentanetriol, 2,3,4-pentanetriol, 1,2,3-hexanetriol, 2,3,4-hexanetriol, 1,2,3-heptanetriol, 2,3,4-heptanetriol, 3,4,5-heptanetriol, 1,2,3-octanetriol, 2,3,4-octanetriol, and 3,4,5-octanetriol.

16. A photoconductor in accordance with claim 1 wherein said at least one charge transport layer is from 1 to about 2 layers.

17. A photoconductor in accordance with claim 1 wherein said at least one charge transport layer is 1 layer.

18. A photoconductor in accordance with claim 1 wherein said at least one charge transport layer is comprised of a top charge transport layer and a bottom charge transport layer, and wherein said top layer is in contact with said bottom layer, and said bottom layer is in contact with said photogenerating layer.

19. A photoconductor comprised of a substrate; a photogenerating layer thereover comprised of a titanyl phthalocyanine, and an alkyltriol component; and a charge transport layer, and wherein said titanyl phthalocyanine is Type V and prepared by dissolving a Type I titanyl phthalocyanine in a solution comprising a trihaloacetic acid and an alkylene halide; adding said mixture to a solution comprising an alcohol and an alkylene halide thereby precipitating a Type Y titanyl phthaiocyanine; and contacting said Type Y titanyl phthalocyanine with a monohalobenzene; and wherein said alkyltriol is selected from the group comprised of 1,2,3-propanetriol, 1,2,3-butanetriol, 1,2,3-pentanetriol, 2,3,4-pentanetriol, 1,2,3-hexanetriol, 2,3,4-hexanetriol, 1,2,3-heptanetriol, 2,3,4-heptanetriol, 3,4,5-heptanetriol, 1,2,3-octanetriol, 2,3,4-octanetriol, 3,4,5-octanetriol, and suitable mixtures thereof.

20. A photoconductor comprised of a substrate, a photogenerating layer, and a charge transport layer, and wherein said photogenerating layer contains a titanyl phthalocyanine Type V pigment, a resin binder, and an alkyltriol, wherein said titanyl phthalocyanine is prepared by dissolving a Type I titanyl phthalocyanine in a solution comprising a trihaloacetic acid and an alkylene halide; adding said mixture comprising the dissolved Type I titanyl phthalocyanine to a solution comprising an alcohol and an alkylene halide thereby precipitating a Type Y titanyl phthalocyanine; and treating said Type Y titanyl phthalocyanine with a monohalobenzene; and wherein said photoconductor includes a supporting substrate, and wherein said titanyl phthalocyanine is present in an amount of from about 20 to about 80 weight percent in the photogenerating layer, said alkyltriol is present in an amount of from 0.01 to about 20 weight percent, and wherein said charge transport layer is comprised of hole transport molecules present in an amount of from about 30 to about 70 weight percent, and wherein said alkyltriol is selected from the group comprised of 1,2,3-propanetriol, 1,2,3-butanetriol, 1,2,3-pentanetriol, 2,3,4-pentanetriol, 1,2,3-hexanetriol, 2,3,4-hexanetriol, 1,2,3-heptanetriol, 2,3,4-heptanetriol, 3,4,5-heptanetriol, 1,2,3-octanetriol, 2,3,4-octanetriol, and 3,4,5-octanetriol.

21. A photoconductor in accordance with claim 20 wherein said titanyl phthalocyanine Type V possesses diffraction peaks at Bragg angle 2Θ ±0.2°at about 9°, 9.6°, 24°, and 27.2°.

22. A photoconductor in accordance with claim 20 wherein said alkyltriol is present in an amount of from about 0.05 to about 10 weight percent.

23. A photoconductor in accordance with claim 20 wherein said photogenerating layer further contains a polycarbonate resin binder, and said charge transport layer contains a polycarbonate resin binder; said substrate is comprised of an insulating or conducting material; said photogenerating layer is situated between said charge transport layer and said substrate; and said photogenerating layer is formed from a dispersion of said titanyl phthalocyanine, said polycarbonate, and said alkyltriol in monochlorobenzene or tetrahydrofuran.

24. A photoconductor in accordance with claim 20 wherein said alkyltriol functions as a stabilizing additive for said titanyl phthalocyanine.

25. A photoconductor in accordance with claim 22 wherein said alkyltriol is selected from at least one of the group comprised of 1,2,3-propanetriol, 1,2,3-butanetriol, 1,2,3-pentanetriol, 2,3,4-pentanetriol, 1,2,3-hexanetriol, 2,3,4-hexanetriol, 1,2,3-heptanetriol, 2,3,4-heptanetriol, 3,4,5-heptanetriol, 1,2,3-octanetriol, 2,3,4-octanetriol, and 3,4,5-octanetriol.

26. A photoconductor in accordance with claim 1 wherein said alkyltriol is 1,2,3-propanetriol.

27. A photoconductor in accordance with claim 19 wherein said alkyltriol is 1,2,3-propanetriol.

28. A photoconductor in accordance with claim 20 wherein said alkyltriol is 1,2,3-propanetriol.

29. A photoconductor in accordance with claim 1 wherein said alkyl in said alkyltriol contains from 3 to about 18 carbon atoms.

* * * * *